US012054348B2

(12) United States Patent
Robadey

(10) Patent No.: US 12,054,348 B2
(45) Date of Patent: Aug. 6, 2024

(54) METHOD AND STACKING DEVICE FOR SHEET ELEMENT DECKS

(71) Applicant: BOBST MEX SA, Mex (CH)

(72) Inventor: Pierre Robadey, Lausanne (CH)

(73) Assignee: BOBST MEX SA, Mex (CH)

( * ) Notice: Subject to any disclaimer, the term of this patent is extended or adjusted under 35 U.S.C. 154(b) by 151 days.

(21) Appl. No.: 17/756,990

(22) PCT Filed: Dec. 10, 2020

(86) PCT No.: PCT/EP2020/085546
§ 371 (c)(1),
(2) Date: Jun. 7, 2022

(87) PCT Pub. No.: WO2021/116294
PCT Pub. Date: Jun. 17, 2021

(65) Prior Publication Data

US 2023/0018771 A1 Jan. 19, 2023

(30) Foreign Application Priority Data

Dec. 10, 2019 (EP) ..... 19020684

(51) Int. Cl.
*B65H 29/66* (2006.01)
*B65H 31/30* (2006.01)
*B65H 39/06* (2006.01)

(52) U.S. Cl.
CPC ..... *B65H 29/6636* (2013.01); *B65H 31/3081* (2013.01); *B65H 39/06* (2013.01);
(Continued)

(58) Field of Classification Search
CPC ..... B65H 29/6636; B65H 31/3081; B65H 39/06; B65H 2301/42122;
(Continued)

(56) References Cited

U.S. PATENT DOCUMENTS 4,270,743 A * 6/1981 Crampton ..... C12Q 1/04 271/182
4,934,687 A * 6/1990 Hayden ..... B65H 9/04 271/189

(Continued)

FOREIGN PATENT DOCUMENTS

BE 1019776 A3 12/2012
CN 1718523 A 1/2006

(Continued)

OTHER PUBLICATIONS

European Patent Office, International Search Report, PCT/EP2020/085546, Mar. 5, 2021, 4 pages, Europe.

*Primary Examiner* — Leslie A Nicholson, III
(74) *Attorney, Agent, or Firm* — Bookoff McAndrews, PLLC

(57) ABSTRACT

A method for generating decks of sheet elements (18) comprises the steps of positioning a set of numerous sheet elements (18) onto a transport surface of a transport device (30) to partly overlap in transport direction (T). The set of overlapping sheet elements (18) is moved against a stop member (44). The stop member (44) is moved in the transport direction (T) with a lower velocity than a velocity of the transport surface. By maintaining displacement of sheet elements (18) which are not yet contacting stop member (44) all sheet elements are shifted towards stop member (44) to define a deck. The method is carried out by a corresponding device.

11 Claims, 7 Drawing Sheets

(52) U.S. Cl.
CPC ..... *B65H 2301/42122* (2013.01); *B65H 2301/42172* (2013.01); *B65H 2301/4447* (2013.01); *B65H 2701/1914* (2013.01)

(58) Field of Classification Search
CPC .. B65H 2301/42172; B65H 2301/4447; B65H 2701/1914
USPC ..... 271/262, 285
See application file for complete search history.

(56) References Cited

U.S. PATENT DOCUMENTS

| | | | | |
|---|---|---|---|---|
| 5,394,974 | A | 3/1995 | Reist | |
| 6,293,544 | B1 | 9/2001 | Fedinatz | |
| 7,556,247 | B1 | 7/2009 | Delfer et al. | |
| 7,588,239 | B2 * | 9/2009 | Marcinik | B65H 39/06 198/604 |
| 7,942,398 | B1 | 5/2011 | Marcinik | |
| 10,597,232 | B2 * | 3/2020 | Oguri | B65H 31/3081 |
| 2011/0133385 | A1 * | 6/2011 | Marcinik | B65H 5/023 271/275 |

FOREIGN PATENT DOCUMENTS

| | | | |
|---|---|---|---|
| CN | 109928183 | A | 6/2019 |
| DE | 202006018443 | U1 | 2/2007 |
| DE | 202007001451 | U1 | 5/2007 |
| EP | 2617667 | A1 | 7/2013 |
| JP | H05193805 | A | 8/1993 |
| JP | H09502153 | A | 3/1997 |
| JP | H09328250 | A | 12/1997 |

* cited by examiner

METHOD AND STACKING DEVICE FOR SHEET ELEMENT DECKS

CROSS-REFERENCE TO RELATED APPLICATION(S)

This patent application is a National Stage Application under of 35 U.S.C. § 371 of International Patent Application No. PCT/EP2020/085546, filed on Dec. 10, 2020, which claims priority to European Application No. 19020684.7, filed on Dec. 10, 2019, the entireties of which are incorporated herein by reference.

FIELD OF THE INVENTION

The present invention relates to a method and a stacking device for generating sheet element decks.

BACKGROUND OF THE INVENTION

Sheet element decks can be made from paper, cardboard (including corrugated board) or plastic which is printed or laminated. Usually, such sheet elements are printed or laminated by using a blank from which the sheet elements are die-cut in a converting machine. The sheet elements are transported one after the other in rows to be subsequently stacked in decks.

For a method and a device for stacking it is decisive that the sheet elements are arranged in a given sequence within the deck and that a jam of sheet elements during transport and stacking is avoided. A typical example where stacking in a fixed sequence is required is a deck of playing cards. In most cases, each card is different from the other within one deck. The playing cards needs to be arranged in a predetermined succession, e.g. the playing cards of one color shall be arranged one after the other.

Documents JPH05193805 and JPH09328250 disclose examples of stacking devices for stacking and accumulating sheet elements behind a stop member. When a desired number of sheet elements have been stacked, the stop member moves away and releases the formed stack.

Document U.S. Pat. No. 7,556,247 discloses a printer-lane packaging method for printing document sets having a variable number of sheet pages. The sheets can first be isolated so that required document sets are generated, then stacked and packaged.

Document BE1019776 discloses an apparatus for producing a deck of cards. The apparatus comprises conveyor belts arranged to feed sheet elements into a first sorting device overlapping cutout sheet elements on top of each other. An additional cutting device is arranged further downstream and is configured to cut the sheet elements into separate cards, while feeding the cards into a funnel-shaped stacking device so that they form a deck.

SUMMARY

It is an object of the present invention to provide a method and a stacking device for generating decks of sheet elements wherein the sheet elements are perfectly aligned to each other and wherein a jam of sheet elements during transportation and stacking is avoided.

This object is achieved by a method for generating decks of sheet elements, comprising the steps of:

positioning a set of numerous sheet elements onto a transport surface of a transport device one after another such that the sheet elements are partly overlapping with their adjacent sheet elements, wherein the transport device has a transport direction, and wherein the last sheet element of the set with respect to the transport direction is positioned to be the lowermost sheet element of the set, and the other sheet elements being positioned so that their rear end lies onto the front end of the sheet element being adjacent in counter-transport direction, so as to form a row of overlapping sheet elements, moving the row of overlapping sheet elements in the transport direction, and moving the overlapping sheet elements against a stop member, which is firstly contacted by the uppermost sheet element, until the lowermost sheet element is completely shifted underneath an adjacent sheet element, and wherein the stop member is moved in the transport direction with a lower velocity than a velocity of the transport surface.

The term "completely shifted underneath" means that the lowermost sheet is completely contained underneath the uppermost sheet element. In such a position, the uppermost and lowermost sheet elements are aligned by their surrounding edges.

It has been found that the sheet elements lying on a transport surface, i.e. moving surface, may slide underneath each other only perfectly, if the last sheet element in the row of overlapping sheet elements is the lowermost in order to have a large contact area to the transport surface. The deck is generated starting from its uppermost sheet element, and lower sheet elements reaching the stop member are shifted underneath during formation of the deck. The present invention does neither need plates moving towards each other in order to shift the sheet elements onto each other nor suction devices for engaging the individual sheet elements in order to stack them.

A moving stop member allows to maintain a flow of sheet elements and a flow of the decks. The leading stop member thus overrides the movement of the row of sheet elements on the transport surface in the transport direction.

Preferably, the sheet elements are positioned so that adjacent sheet elements are overlapping before being moved relative to each other.

The sheet elements can be rectangular with rounded corners, as shown in the figures, but can also have different shapes, for example unfolded boxes, squares or rectangles without rounded corners, as long as front end of the sheet element can be effectively stopped and maintained in a well-defined orientation by the stop member.

In an embodiment, at least one endless belt is used for the transport device. The upper portion of the belt, more precisely its upper surface, defines the transport device.

The sheet elements may be positioned one behind each other on a transport device of an inlet station without overlapping each other. In the inlet station or at the end thereof, the sheet elements are repositioned to partly overlap by decelerating the sheet elements one after the other. Thus, subsequently arriving sheet elements are partly slipping underneath their front sheet element.

In an embodiment, rows of a set of overlapping sheet elements are arranged parallel to each other and the sheet elements of each row are stacked. The rows are arranged so that their longitudinal extension coincide with the direction of transportation.

Thus, each row comprises the sheet elements of a partial deck, and the partial decks from each row are together defining the final, large deck. In order to generate a complete deck, the partial decks defined by parallel rows are shifted transverse or perpendicular to the transport direction after being stacked to form the common, larger deck.

The present invention also provides a stacking device. The stacking device is configured to generate a sheet element deck and comprises

- a first stacking station having a transport device comprising at least one endless belt defining an upper transport surface onto which sheet elements are deposited,
- the endless belt being able to move the sheet elements in a transport direction, and
- a stop member configured to move in the transport direction and being located adjacent to the transport surface, the stop member being arranged to be contacted by sheet elements deposited onto the transport surface, wherein the endless belt is configured to be driven faster than the stop member.

The term "endless belt" comprises a belt as well as an endless chain or any known device which implements the same function.

The stop member may protrude upwardly from underneath a plane defined by the transport surface. This allows the device to be designed compactly.

The stop member can be attached to an endless belt which is arranged underneath the plane. This endless belt may also have several stop members distanced from each other so that during one revolution of the endless belt several decks of sheet elements are generated.

Preferably, the transport devices are defined by endless belts, wherein between adjacent endless belts a stop member is arranged.

The stop member is fixed to a separate endless belt.

To each endless belt of the transport device two stop members are assigned, one stop member on each longitudinal edge of the associated endless belt. Each sheet element being preferably transported by one endless belt of the transport device and stopped by two stop members, but the reverse is also possible: each sheet can be transported by two endless belts of the transport device and stopped by one single stop member, in which case two endless belts are assigned to each stop member. The first alternative being preferred because the stability of the sheet element is better, and thus the adjustment of the first stacking station less critical.

The endless belts of the transport device and of the stop members are arranged offset in transport direction, in particular wherein the endless belts of the stop members are taking over the decks from the endless belts of the transport device after the end of the transport device in transport direction.

Furthermore, several transport sub-devices for sheet elements can be arranged parallel to each other, in particular wherein a stop member is aligned between adjacent transport sub-devices of sheet elements. One stop member may be assigned to two adjacent rows of sheet elements.

In an embodiment, one common drive for the transport sub-devices for the sheet elements and/or one common drive for the stop members are or is provided. This reduces the number of parts enables the stacking device to be conceived in a cost-efficient manner. One example to carry out this feature is to have one common driving roller onto which several endless belts are wound.

In an embodiment, the stacking device comprises at least one slider movable crosswise to the transport direction to shift adjacent partial decks towards each other and above each other to form a common deck. The slider can be part of a station or module which is arranged immediately after rows of sheet elements are pushed together to form partial decks lying side by side.

In an embodiment, an inlet station is arranged before the stacking station and a decelerating element is provided for contacting the upper surfaces of the sheet elements in order to arrange a row of overlapping sheet elements. The row of overlapping sheet elements is transported to the stacking station.

BRIEF DESCRIPTION OF THE DRAWINGS

In the accompanying drawings

DETAILED DESCRIPTION

Figure 1:
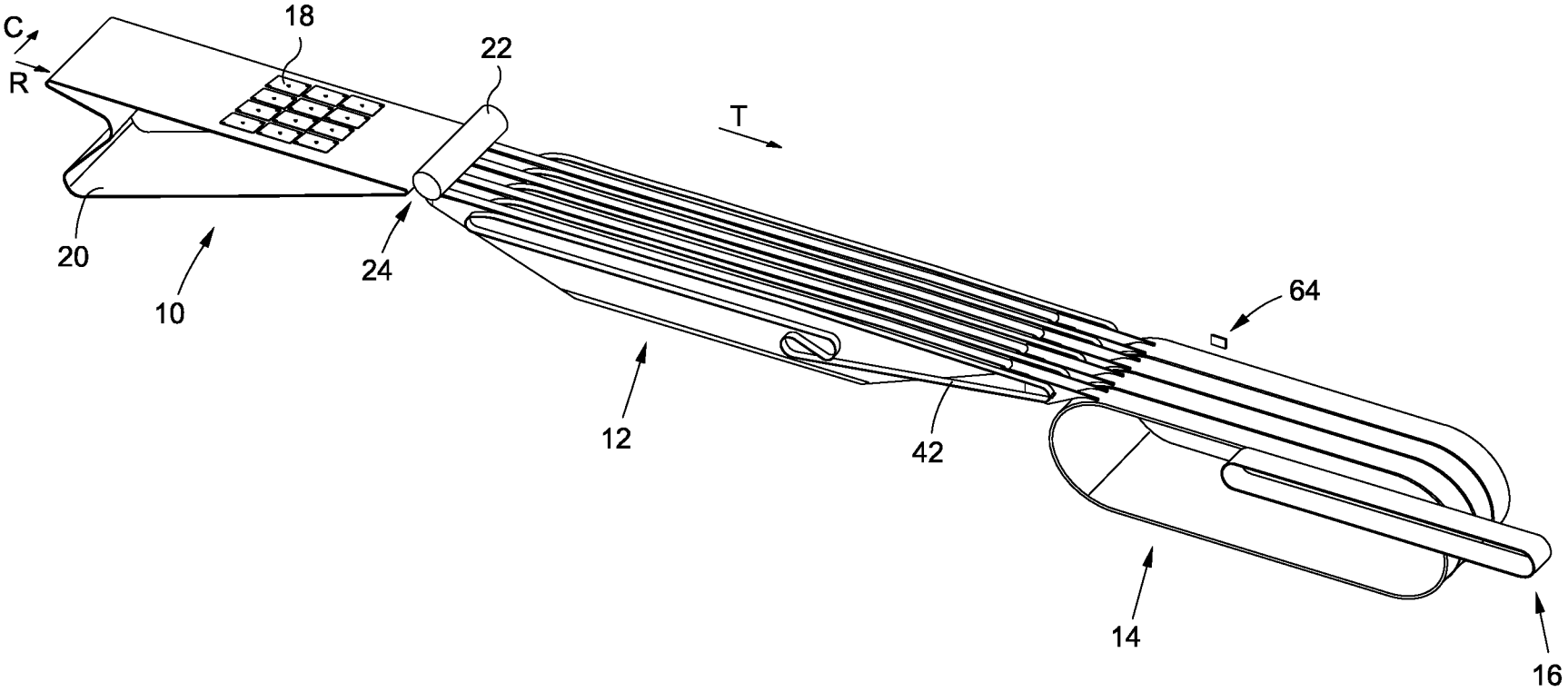
FIG. 1 shows a perspective view of a stacking device according to the present invention for carrying out the method according to the invention in a first phase of the method.
Figure 2:
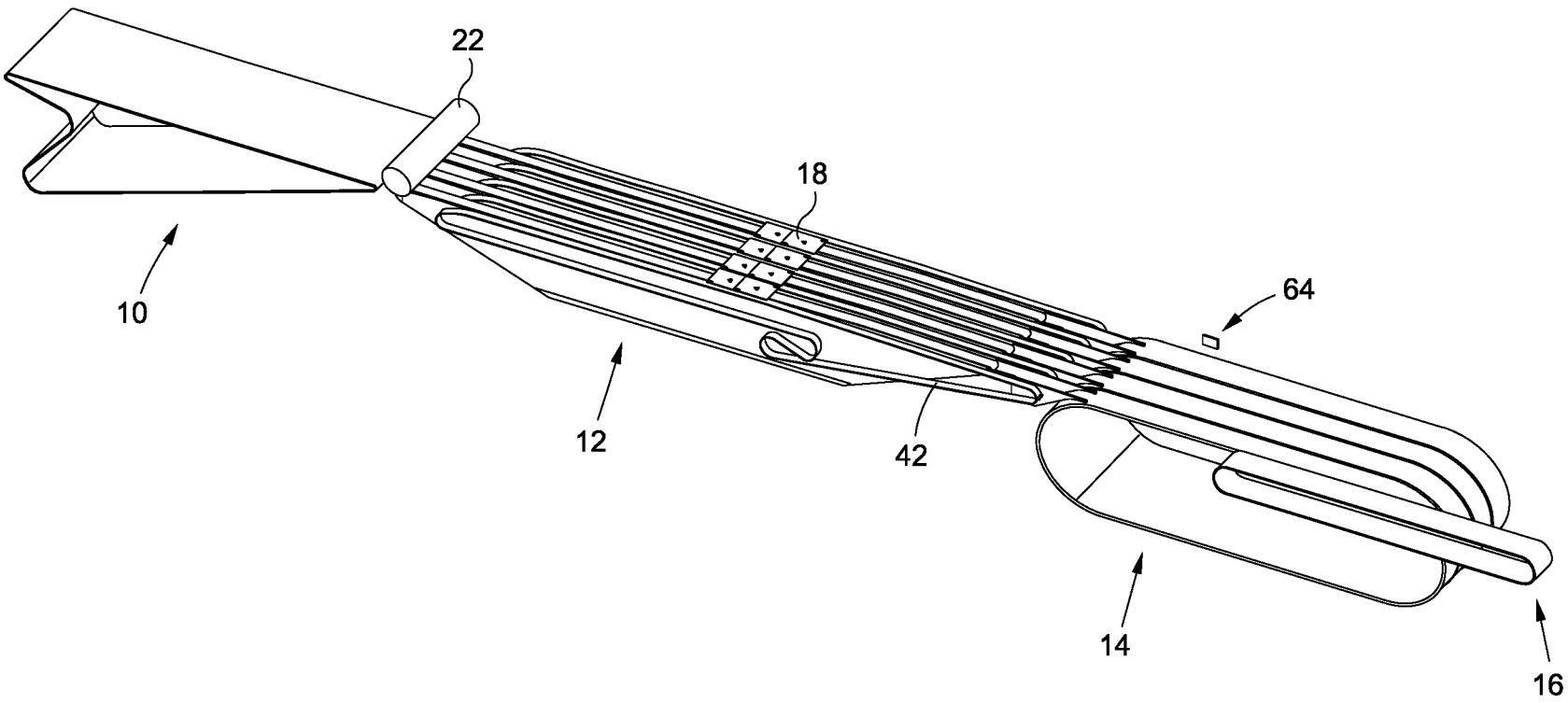
FIG. 2 shows the device according to FIG. 1 in a second phase of the method.
Figure 3:
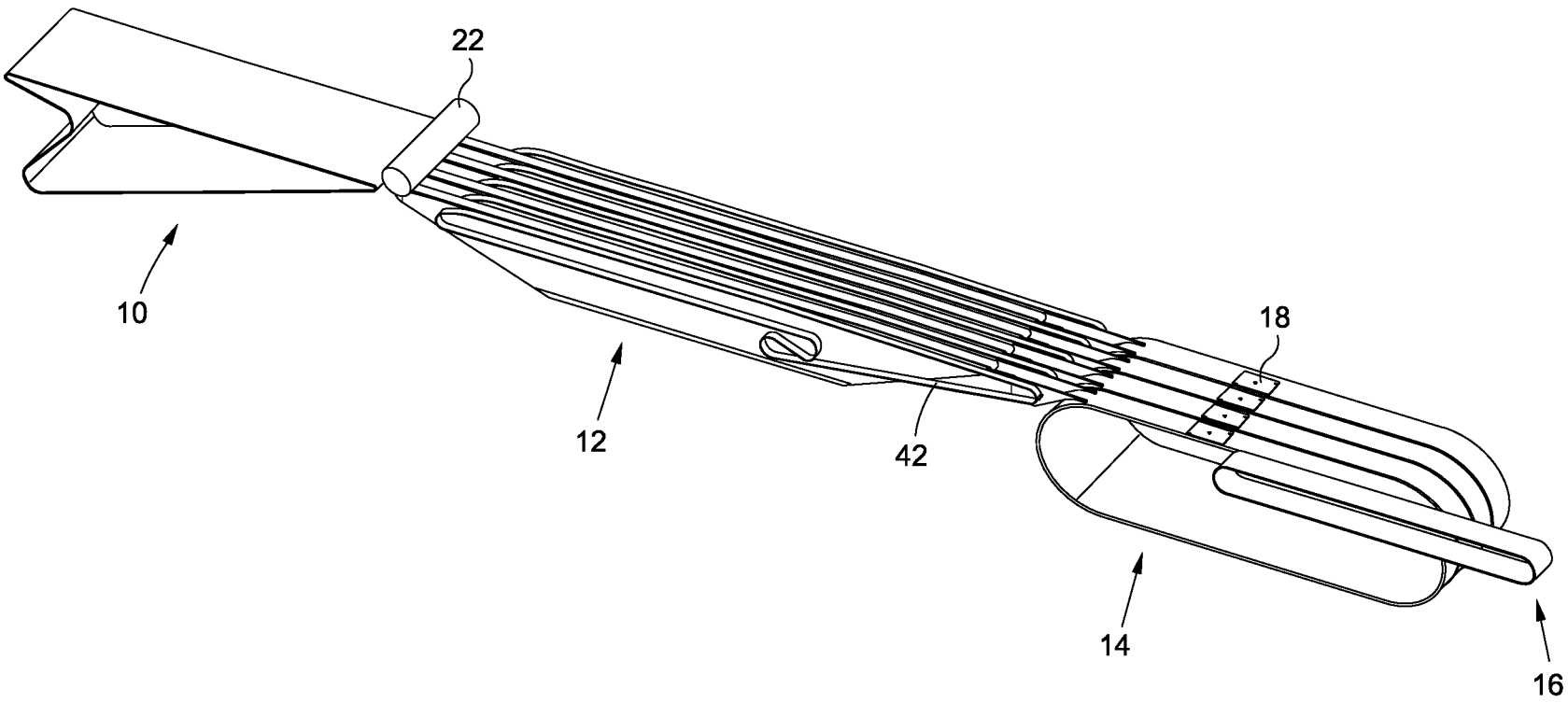
FIG. 3 shows the device according to FIG. 1 in a third phase of the method.

In FIG. 1, a stacking device for generating decks of sheet elements made of printed and/or laminated paper, cardboard or plastic is shown. The device comprises four stations or modules, an inlet station 10, a first stacking station 12, a second stacking station 14 and a subsequent outlet station 16. The stacking device can, however, comprise the first stacking station 12 without the second stacking station 14.

In the shown example, sheet elements 18 are printed playing cards positioned next to each other without contacting each other in rows R and columns C. A set of sheet elements 18 is defined by all sheet elements 18 of one row R.

All stations 10 to 16 comprise transport means which are moving the sheet elements 18 in a common transport direction T. The transport direction T coincides with the direction of rows R, which is also referred to as the longitudinal direction.

Inlet station 10 comprises an endless belt drive with a belt 20. Driving and deflecting rollers are not shown in this figure in order to increase the clarity.

Sheet elements 18 are placed onto the upper portion of the belt 20. The upper portion of the belt 20 forming a transport table. More specifically, the sheet elements 18 are received from a printing press and a subsequent die-cutting machine.

At the end of inlet station 10 and belt 20 a deceleration element 22 is provided. Deceleration element 22 can be a roller or cylinder having an elastomeric surface.

Figure 4:
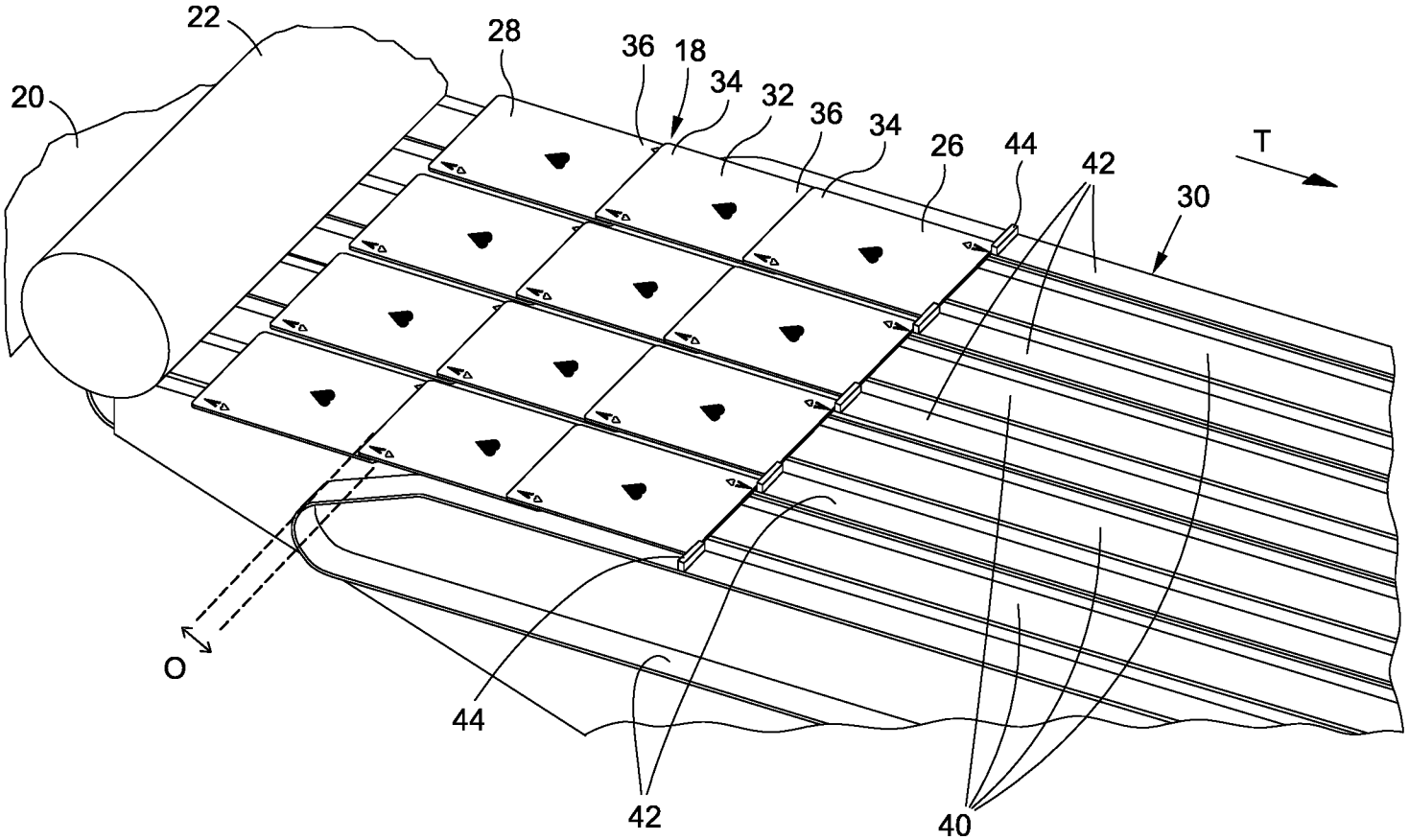
FIG. 4 shows an enlarged perspective view of the device according to FIG. 1 within the second phase.

The transport device 30 of the first stacking station 12 is designed as a transport table with a transport surface shown in FIG. 4 defined by several parallel commonly driven endless belts 40 which define transport sub-devices.

Figure 7:
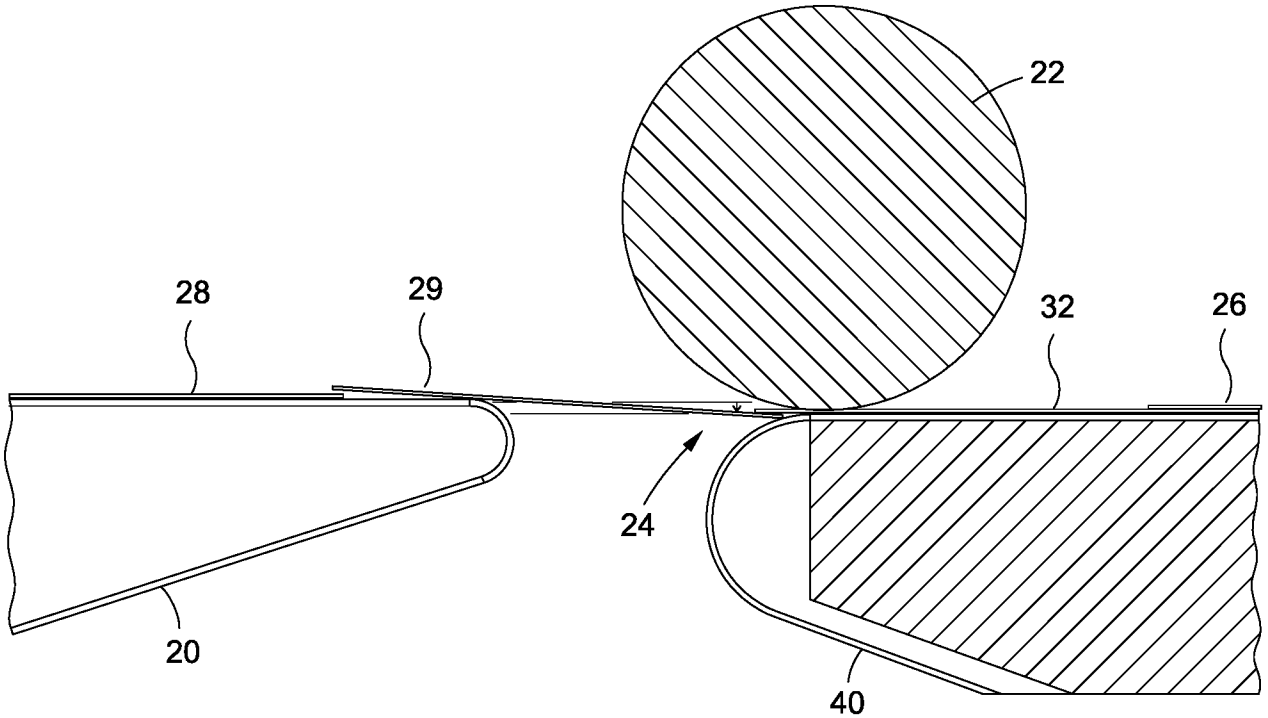
FIG. 7 shows a side view of the device according to FIG. 1 to build the inverted shingle stream of elements between the first and second phase of the method.

Underneath decelerating element 22, a deepened or lower portion 24 is provided, as shown in FIG. 7.

As in the illustrated embodiment, the lower portion is achieved by arranging the upper surface of the belt 40 at a vertically lower height than the upper surface of the belt 20.

The tangential speed of the decelerating element 22 and the speed of the belt 40 is equal. The decelerating element 22 and the belt 40 are travelling slower than the belt 20. The lower portion 24 causes the back edge of a preceding sheet element 29 to be raised when received in-between the decelerating element 22 and the belt 40. The preceding sheet element 29 travels slower than the following sheet 28, which is on belt 20 and whose front side gets shifted underneath the raised back side of sheet element 29. This allows the generation of an inverted shingle stream of elements. The back and front of the sheet elements are defined with respect to the transport direction.

The decelerating element 22 and the lower portion 24 are cooperating to arrange sheet elements 18 of each row R in an overlapping manner, partly on top of each other as shown in FIG. 4. These overlapping adjacent sheet elements overlap by a given overlap distance O at the entry of the first stacking station and before being stacked further by the first stacking station. The overlap distance O can vary depending on the shape and material of the sheet elements. For example, the overlap distance O may correspond to a percentage of between to 10 to 25% of the length of the sheet elements 18 in the direction of transport T, i.e. for rectangular shaped sheet elements 18. Such an overlap distance O ensures that the sheet elements 18 perform a gradual and continuous overlap in the stacking station 12. This avoids an abrupt deceleration of the sheet elements 18 and thus prevents a loss in production speed. The percentage may be set in an adjustment phase by conducting some trial-and-error tests.

Hence, in order to overlap the sheet elements 28 and 29 in an inversed manner there is a need for a height difference between the belt 20 of the inlet station 10 and the downstream-located belt 40, in combination with decelerating a preceding sheet element 29 in relation to a following sheet element 28. This creates the i an inverted shingle stream of elements 18.

Therefore, in a non-illustrated alternative embodiment, the upper surface of belt 20 can be located at a vertically lower height than the upper surface of the belt 40. The belt 40 is then arranged at such a height distance and horizontal distance from the belt 20 so that the leading front edge of the sheet elements 18 s grasped and guided upwardly to be driven by the belt 40 in the transport direction T.

The specific arrangement of sheet elements 18 at the rear end portion of stacking station 12 is shown in FIG. 4. The first (front) sheet element 26 of each row R defines the uppermost sheet element of the row R and the last (rear) sheet element 28 defines the lowermost sheet element of the row R. In more detail, the last sheet element 28 lies with its complete underside on the transport device 30. The immediately adjacent (here the middle) sheet element 32 has a rear end 34 lying on the upper side of the front end 36 of sheet element 28. The sheet element adjacent to sheet element 32 in transport direction T, here the first sheet element 26 lies with its rear end 34 on the upper side of the front end 36 of sheet element 32. Thus, first sheet element 26 is the uppermost and last sheet element 28 is the lowermost sheet element. We call this arrangement of sheet elements an inverted shingle stream of elements. The rear and the front are defined with respect to transport direction, the sheets elements being transported from rear to front.

The transport device 30 of the first stacking station 12 is designed as a transport table with a transport surface shown in FIG. 4 defined by several parallel commonly driven endless belts 40 which define transport sub-devices. Belts 40 have common driving and deflecting rollers. A first driving or deflecting roller (not shown) is arranged underneath and close to deceleration element 22.

Between adjacent endless belts 40 and, preferably, along the outer edges of the outermost endless belts 40 (seen in transport direction T) drive elements 42 in the form of endless belts are arranged parallel to endless belts 40. The transport surface defined by the upper sides of the upper portions of endless belts 40 is arranged above a plane defined by the upper sides of the upper portions of drive elements 42 so that sheet elements 18 are not contacting the upper sides of drive elements 42 but the upper sides of belts 40, only.

Figure 5:
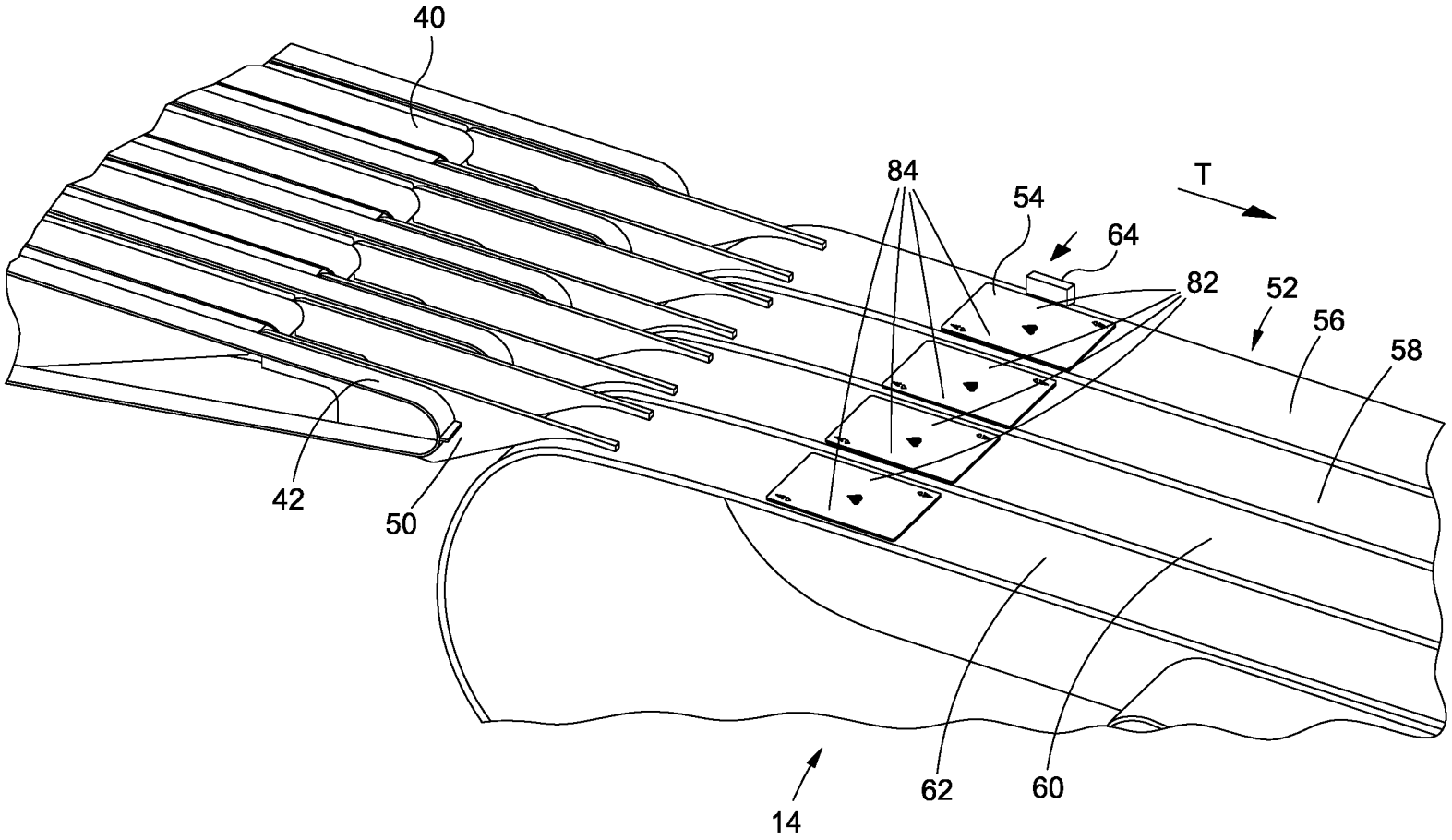
FIG. 5 shows an enlarged perspective view of the device according to FIG. 1 within the third phase.

As can be seen from FIGS. 4 and 5, the loops defined by endless belts 40 and drive elements 42 are offset in transport direction T, in other words, when moving along transport direction, the loop defined by drive elements 40 start before and ends before the loop defined by endless belt 42.

The plurality of drive elements 42 may also have common driving and deflecting rollers so as to move with the same velocity.

On each endless drive element 42, one or more stop members 44 are attached and are protruding upwardly (when the respective portion of endless belt of drive element 42 defines the upper portion) as seen in FIG. 4. Each stop member 44 is plate-like and extends transversely to transport direction T, preferably along the full width of drive element 42. Stop members 44 extend and protrude over the transport surface defined by the upper surfaces of endless belts 40. The height of the stop members 44 may correspond to or exceed the height of each partial deck in each row R.

The first stacking station 12 is configured to form decks of sheet elements of each single row R.

When sheet elements 18 are aligned at the front end of transport device 30 to overlap, the sheet elements are moved forward by endless belts 40. Drive elements 42 are driven with a velocity which is lower than the velocity of endless belts 40. Thus, the first sheet elements 26 reach and contact the slower stop members 44 when being transported by endless belts 40 in transport direction T. FIG. 4 shows the first contact of the front ends of the first sheet elements 26 with the stop members 44.

As can be seen from FIG. 4, the middle stop members 44 are contacted by the first sheet elements 26 of adjacent rows. Thus, each sheet element 26 is decelerated by two stop members 44 at their left and right hand edges seen in transport direction T.

Due to the deceleration of the first sheet element 26, the middle sheet element 32 and the last sheet element 28 are still moved forward by endless belts 40 and are sliding underneath the first sheet element 26 of their associated row. Thus, at the end of the transport track of endless belts 40, a deck 54 of each row R of sheet elements 18 is formed.

As the loops of endless belts 40 are ending in transport direction T before the loops of drive elements 42 (see FIG. 5) the decks 54 are taken over by drive elements 42. The speed of the first sheet elements 26 in the first column C in the first stacking station 12 is thus defined by the drive elements 42, as the first sheet elements 26 abut against the stop members 44. Hence, the speed of all the sheet elements 18 is decreased from the speed of the belt 40 to the speed of the drive elements 42 at the outlet end of the first stacking station 12. Plate-like vertical sliders 50 are bridging a gap between the ends of the loops of drive elements 42 and a subsequent endless belt or several adjacent endless belts 52 of the second stacking station 14. Thus, drive elements 42 are delivering decks 54 to endless belt 52. Optionally, a slope can be arranged on sliders 50 so as to help the sheet elements to slide (downwards) toward endless belts 52. Optionally, as an alternative, an additional set of endless belts with a protruding member can be arranged above the sheet elements and above the plate-like vertical slides 50 to push the sheet elements (with the protruding member) in the transition zone between the first stacking station 12 and the second stacking station 14.

The second stacking station 14 is stacking the partial sheet elements stacks transverse to the transport direction T. Endless belt 52 has several tracks 56 to 62, each track 56 to 62 is assigned to a row R. The stacks are transported from an upstream track 56 to a downstream track 62. Each track has an upstream track side 82, which is the longitudinal side that is closer to the upstream track. Each track has also a downstream track side 84 which is the longitudinal side that is closer to the downstream row. "Upstream" and "downstream" are defined according to the transversal direction, i.e. the direction perpendicular to the transport in the plane of the sheet elements; on the stacking second station 14, the stacks are formed from upstream to downstream.

In order to ensure a proper stacking of the sheet elements stacks, a stack on an upstream track must slide above the stacks on the neighboring downstream track. Thus, the downstream track side 84 of an upstream track must lie above the upstream track side 82 of the neighboring downstream track, resulting in a staircase profile. The height difference between two stairs in the profile must be at least as large as the thickness of the stacks of sheet elements entering the second stacking station.

Slider 64 shifts decks 54 onto each other to form a common, larger deck. This is achieved by deck 54 on the upstream track 56 being moved onto adjacent deck 54 which is positioned underneath it on downstream tracks 58 to 62.

Figure 6:
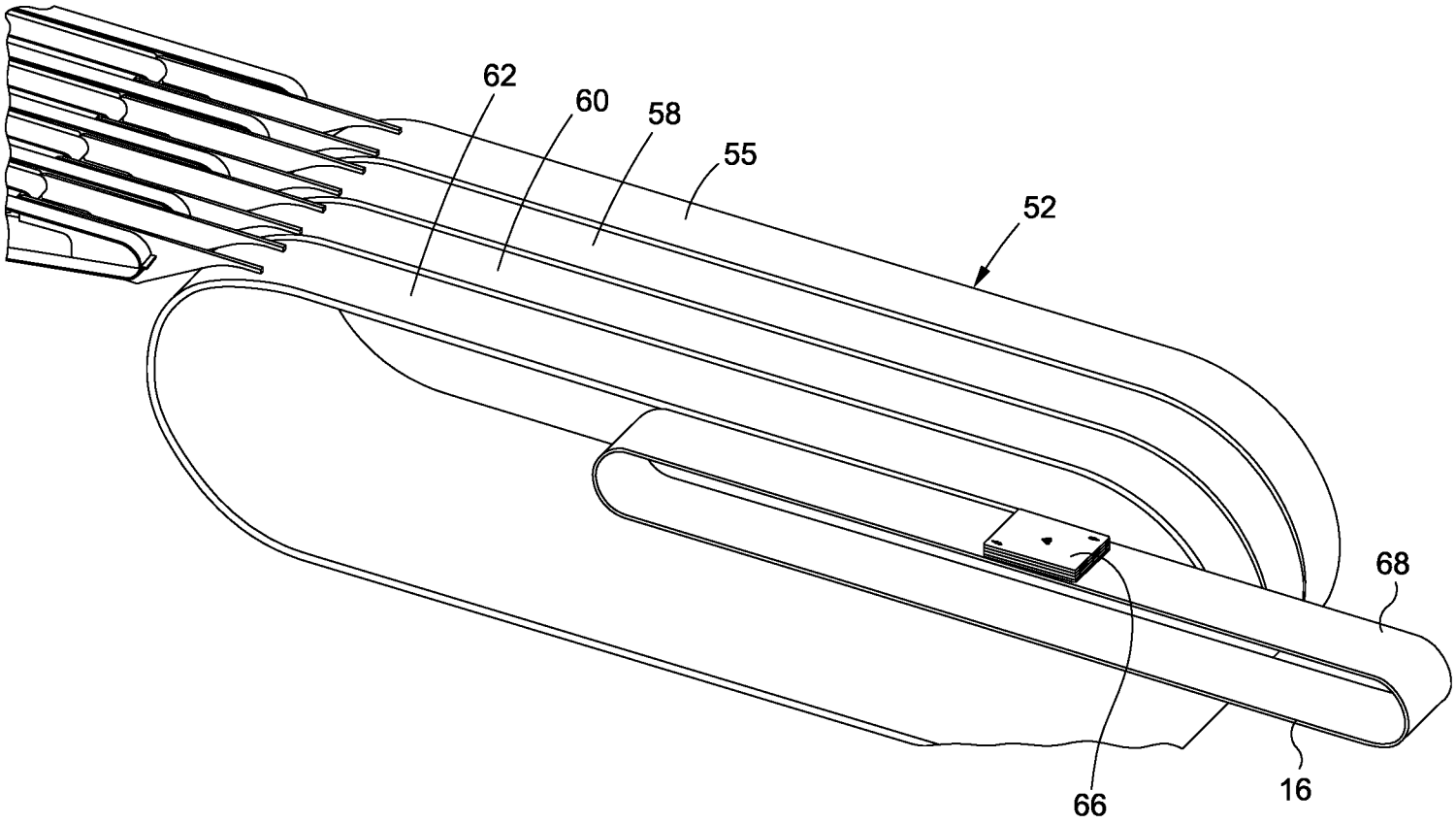
FIG. 6 shows an enlarged perspective view of the device according to FIG. 1 within a final, fourth phase.

Slider 64 shifts decks 54 to define one common deck 66 (see FIG. 6) and, finally, shifts common deck 66 onto an endless belt 68 of outlet station 16.

The present stacking device enables the creation of ordered decks 66 comprising a variable quantity of sheet elements 18. Such a stacking device is suitable in the production of playing cards, as such decks may have a different number of cards 18.

In a converting machine for use together with the present stacking device, the individual sheet elements or cards 18 are produced by printing and processing a substrate in sheet or web form. The printing can for instance be effectuated with a flexographic printing assembly. A die-cutter tool can be used downstream of the printing assembly and is used to cut out the individual sheets or cards 18.

The die cutter tool is provided with a pre-defined cutting arrangement adapted to create cutouts to form the sheet element 18 in rows R and columns C. The arrangement of the rows R and columns C can be modified depending on the number of cards included in the complete deck 66.

The stacking station 12 may therefore be configured to include a variable number of belts 40, 42 in operation. The stacking station 12 can be provided with a number of belts 40, 42 dimensioned for a maximum amount of rows R to be used. The stacking station 12 can be arranged to be slidable in a direction transverse or perpendicular to the direction of transportation. In such a way, the belts 40, 42 can be aligned with the rows R of sheet elements 18. This allows the position of the belts 40, 42 to be laterally shifted to render one or several exteriorly located belts 40, 42 inoperable (e.g. moving, but not receiving any sheets 18 or idle). This enables the stacking station 12 to adapt to job specifications with different number of rows R.

The height of the stop members 44 corresponds to or exceeds the height of each partial deck in each row R. It is therefore advantageous to as a second step use the second stacking station 14 to assemble the partial decks into a complete stack 66.

The invention claimed is:

1. A method for generating a deck of sheet elements, the method comprising:

positioning a set of numerous sheet elements onto a transport surface of a transport device one after another such that the sheet elements are partly overlapping with adjacent sheet elements, wherein the transport device has a transport direction, and wherein a last sheet element of the set with respect to the transport direction is positioned to be a lowermost sheet element of the set, and other sheet elements being positioned so that a rear end of the sheet element lies onto a front end of the sheet element being adjacent in counter transport direction, so as to form a row of overlapping sheet elements, moving the row of overlapping sheet elements in the transport direction, and moving the overlapping sheet elements against a stop member, which is firstly contacted by an uppermost sheet element, until the lowermost sheet element is completely shifted underneath an adjacent sheet element, and wherein the stop member is moved in the transport direction with a lower velocity than a velocity of the transport surface.

2. The method according to claim 1, wherein adjacent sheet elements are overlapping before the stop member is contacted by the uppermost sheet elements.

3. The method according to claim 1, wherein at least one endless belt is used for the transport device.

4. The method according to claim 1, wherein the sheet elements are positioned one behind each other on a transport device of an inlet station without overlapping each other, and wherein the sheet elements are repositioned to partly overlap by decelerating sheet elements one after the other.

5. The method according to claim 1, wherein rows of sets of overlapping sheet elements are arranged parallel to each other, and wherein the sheet elements of each row are stacked.

6. The method according to claim 5, wherein the decks are partial decks and are shifted transverse or perpendicular to the transport direction after being stacked to form a common deck.

7. A stacking device for generating a deck of sheet elements, the stacking device comprising:

a first stacking station having a transport device comprising at least one endless belt defining an upper transport surface onto which sheet elements are deposited, the endless belt being able to move the sheet elements in a transport direction, and a stop member configured to move in the transport direction and being located adjacent to the transport surface, the stop member being arranged to be contacted by sheet elements deposited onto the transport surface, wherein the endless belt is configured to be driven faster than the stop member, wherein several transport sub devices for sheet elements are arranged parallel to each other, in particular wherein a stop member is arranged between adjacent transport sub devices, and wherein the stacking device comprises at least one slider movable crosswise to the transport direction to shift adjacent decks towards and above each other and to form a common deck.

8. The stacking device according to claim 7, wherein the stop member is protruding upwardly from underneath a plane defined by the transport surface.

9. The stacking device according to claim 8, wherein the stop member is attached to an endless belt which is arranged underneath the plane.

10. The stacking device according to claim 7, wherein one common drive for the transport sub devices for the sheet elements and/or one common drive for the stop members are/is provided.

11. A stacking device for generating a deck of sheet elements, the stacking device comprising:

a first stacking station having a transport device comprising at least one endless belt defining an upper transport surface onto which sheet elements are deposited, the endless belt being able to move the sheet elements in a transport direction, and a stop member configured to move in the transport direction and being located adjacent to the transport surface, the stop member being arranged to be contacted by sheet elements deposited onto the transport surface, wherein the endless belt is configured to be driven faster than the stop member, wherein the stacking device comprises an inlet station arranged before a stacking station and a decelerating element for contacting the upper surfaces of sheet elements in order to arrange a row of overlapping sheet elements which is transported to the stacking station.

* * * * *